US005573250A

United States Patent [19]

Kuo

[11] Patent Number: 5,573,250

[45] Date of Patent: Nov. 12, 1996

[54] DARTBOARD CLOCK

[76] Inventor: Kevin Kuo, No. 13-1, Lane 338, Sec. 2, Feng-Shin Rd., Shin-Tien Village, Tan Tzu Hsiang, Taichung Hsien, Taiwan

[21] Appl. No.: 595,859

[22] Filed: Feb. 6, 1996

[51] Int. Cl.[6] ..... F41J 3/00

[52] U.S. Cl. ..... 273/408; D21/124; 368/327

[58] Field of Search ..... 273/348, 403, 273/404, 407, 408; 368/327; D10/122, 123, 124, 126

[56] References Cited

U.S. PATENT DOCUMENTS

| | | | |
|---|---|---|---|
| D. 175,465 | 8/1955 | Gilson | D10/123 |
| 626,995 | 6/1899 | Haigh | 273/140 |
| 3,300,216 | 1/1967 | Haecker | 273/403 |
| 4,850,598 | 7/1989 | Latulippe | 273/408 |

*Primary Examiner*—William H. Grieb
*Attorney, Agent, or Firm*—Bacon & Thomas

[57] ABSTRACT

A dartboard clock includes a disk-like face member, serving as a dial plate, having a front surface on which a dartboard pattern is provided and an opposite back surface on which a circumferential flange is provided. The face member has a central through hole through which a rotating shaft of a timing device is received and fixed therein. Timing hands in the form of darts are provided with holes to engage a remote end of the rotating shaft that projects out of the front surface of the face member so as to have the timing hands run on the front surface. Pins in the form of the point section of a dart are threadingly attached to the back surface of the face member to pierce into a dartboard or a B.B. gun. target board for supporting the dartboard clock on the dartboard. A foldable support member is attached to the back surface of the face member for individually supporting the dartboard clock on a horizontal surface.

8 Claims, 4 Drawing Sheets

DARTBOARD CLOCK

FIELD OF THE INVENTION

The present invention relates to a clock and in particular a clock which has a dial plate with dartboard pattern provided thereon to be releasably fixed to a dartboard and uses darts as timing hands.

BACKGROUND OF THE INVENTION

Dart and B.B. gun shooting are very popular indoor games because they need no sophisticated or expensive equipments and the rules are simple. Thus, the dart game is now a popular entertainment in both home and social activity. The dart game generally uses darts to shoot a dartboard on which a pattern indicating different scores is provided. The dartboard is usually hung on for example a wall and is usually kept on the wall even when the game is not played. Besides being simply hung on the wall, the dartboard provides no other function. It is therefore desirable to make use of the dartboard which is simply hung on the wall when not in use.

SUMMARY OF THE INVENTION

Therefore, an object of the present invention is to provide a dartboard clock which may be attached to a not-in-use dartboard to provide timing function while still allowing the dart game to be played by removing the dartboard clock from the dartboard or simply using the dial plate of the dartboard clock as the dartboard.

It is another object of the present invention to provide a dartboard clock in which the hour hand and minute hand are formed with darts.

A further object of the present invention is to provide a dartboard clock which has a foldable support member to individually support the dartboard clock on a substantially horizontal surface to serve as a regular clock.

In accordance with the present invention, there is provided a dartboard clock comprising a disk-like face member, serving as a dial plate, having a front surface on which a dartboard pattern is provided and an opposite back surface on which a circumferential flange is provided. The face member has a central through hole through which a rotating shaft of a timing device is received and fixed therein. Timing hands in the form of darts are provided with holes to engage a remote end of the rotating shaft that projects out of the front surface of the face member so as to have the timing hands run on the front surface. Pins in the form of the point section of a dart are threadingly attached to the back surface of the face member to pierce into a dartboard or a B.B. gun target board for supporting the dartboard clock on the dartboard. A foldable support member is attached to the back surface of the face member for individually supporting the dartboard clock on a horizontal surface.

BRIEF DESCRIPTION OF THE DRAWINGS

The present invention will be better understood from the following description of preferred embodiments thereof, with reference to the attached drawings, wherein.

DETAILED DESCRIPTION OF THE PREFERRED EMBODIMENTS

Figure 1:
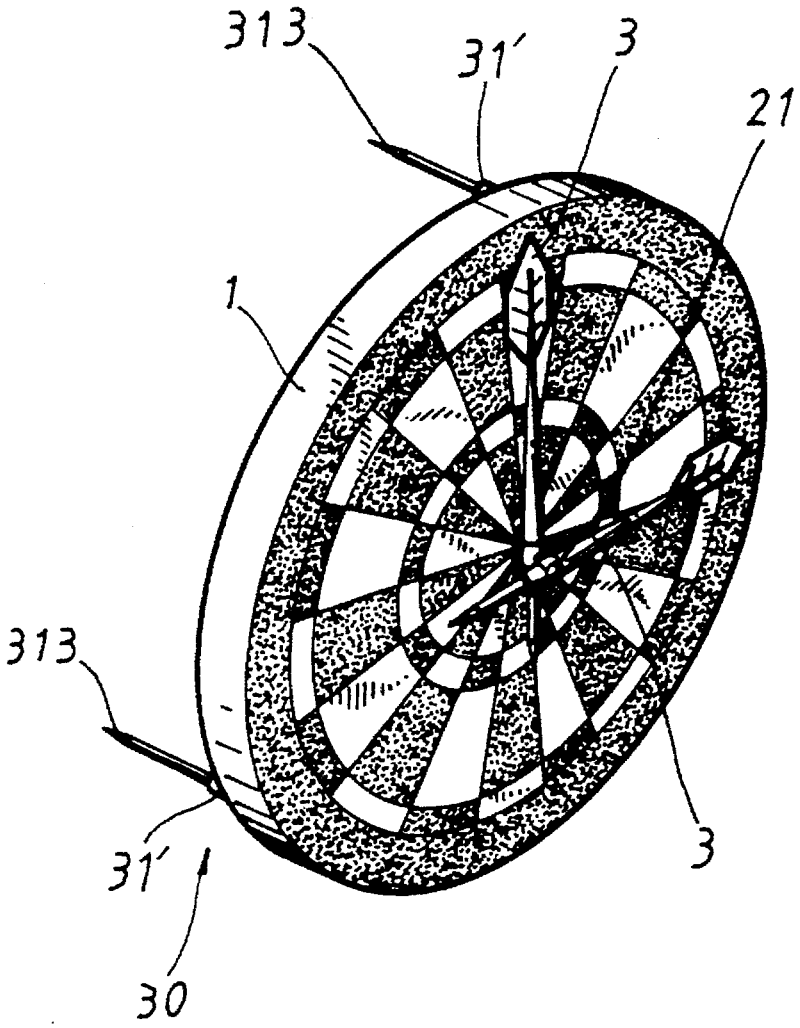
FIG. 1 is a perspective view showing a dartboard clock constructed in accordance with the present invention.
Figure 2:
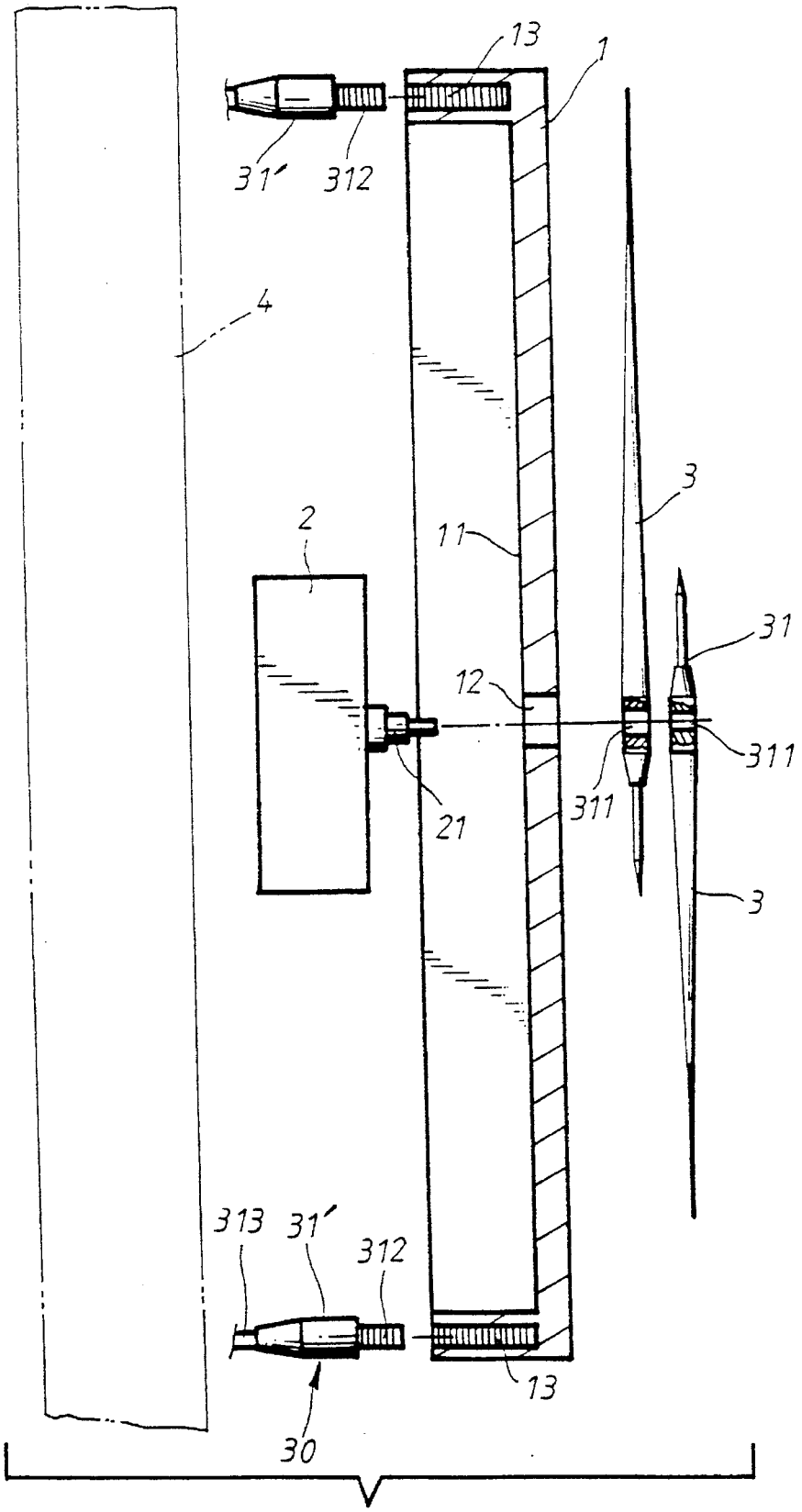
FIG. 2 is a cross-sectional view showing the dartboard clock in accordance with the present invention.

With reference to the drawings and in particular to FIGS. 1 and 2, wherein a dartboard clock constructed in accordance with the present invention is shown, the dartboard clock of the present invention comprises a face member 1 which in the embodiment illustrated is in the form of a circular pan to serve as a dial plate, having a disk plate section 11 with a ring-like circumferential flange formed on a back surface of the face member 1. The face member 1 is preferably provided with a dartboard pattern on a front surface thereof, as shown in FIG. 1. The disk plate 11 has a central through hole 12 formed thereon. A timing device 2 having a rotating shaft 21 extending therefrom is mounted to the back surface of the face member 1 to be located within the circumferential flange by having the rotating shaft 21 extending through and retained within the through hole 12 of the disk plate 11 of the face member 1.

The timing device 2 is well known to those skilled in the art of timer and clock and thus no further detail will be given herein.

The rotating shaft 21 has a remote end extending through the through hole 12 and projecting out of the front surface of the face member 1 to which timing hands are attached to be rotatable therewith. The timing hands comprise at least one hour hand and one minute hand and the rotating shaft 21 comprises co-axially extending tubular members (not explicitly shown) to respectively engage and drive the hour hand and minute hand. This is known to those skilled in the art and will not be further explained.

In accordance with the present invention, the timing hands are formed with darts 3, each of which has an elongated body with a sharp point section 31. A through hole 311 is provided on each of the darts 3 to receive therein the remote end of the rotating shaft 21 so as to fix the darts 3, which serve as timing hands, to the rotating shaft 21.

Figure 3:
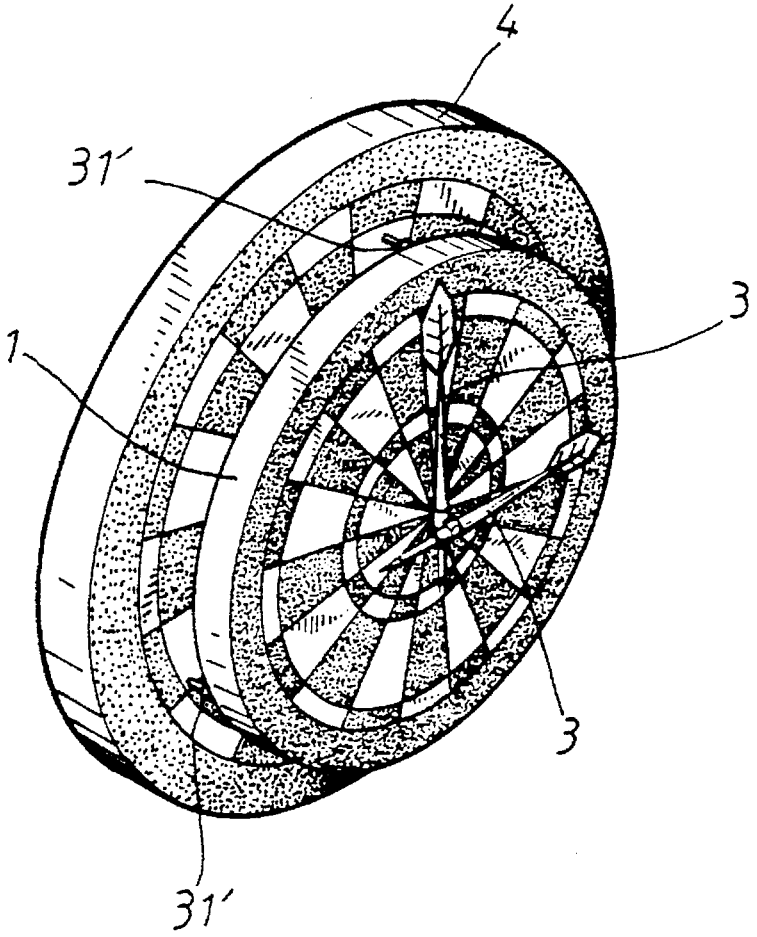
FIG. 3 is a perspective view showing the dartboard clock of the present invention attached to a dartboard.

The face member 1 is provided with anchoring means 30 which comprises pins 31' having sharpened ends 313 extending from for example the circumferential flange of the face member 1 to allow the face member 1, with the timing device 2 fixed on the back side thereof, to be anchored on for example a dartboard 4 (see FIG. 3) or other plate member made of a material that allows the pins 31' to pierce therein, such as a B.B. gun target board. The pins 31' may be integrally formed on the circumferential flange of the face member 1 or preferably, the sharpened pins 31' are members that are separate from the face member 1, as shown in FIG. 2, and are formed with the point section 31 of a dart 3 so that the pins are labelled with reference numeral 31'. Under such a condition, the pins 31' are each provided with a threaded section 312 to threadingly engage an inner-threaded hole 13 that is formed on the circumferential flange of the face member 1 so as to mount the pins 31' to the circumferential flange of the face member 1.

Alternatively, the pins 31' may be force-fit into holes formed on the face member 1 to fix the pins to the face member.

Figure 4:
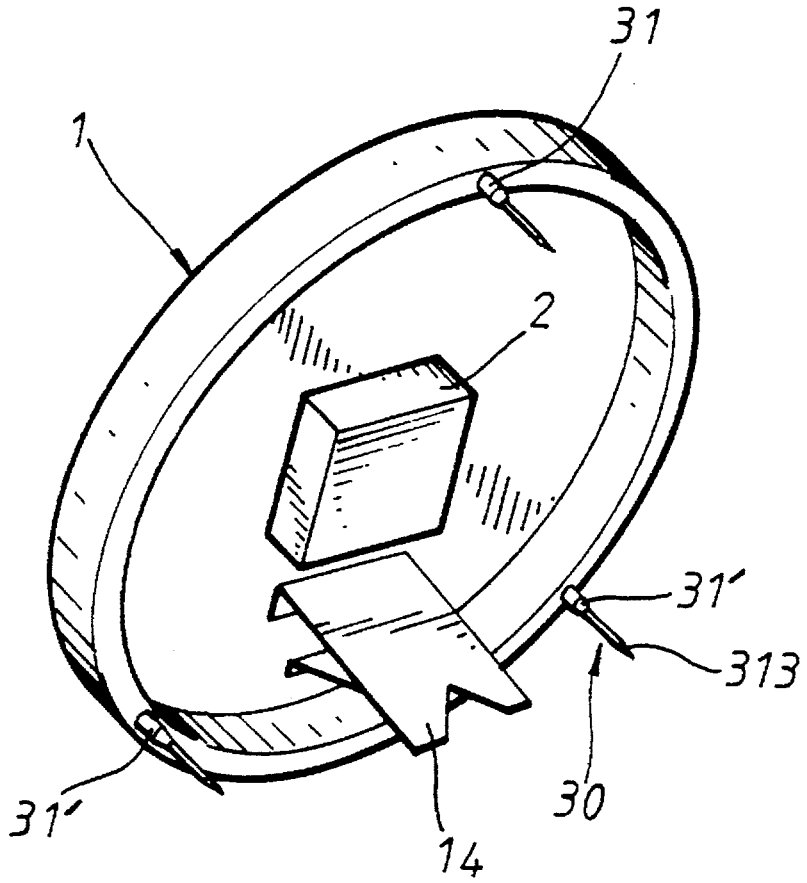
FIG. 4 is a perspective view showing back side structure of the dartboard clock in accordance with the present invention.

In accordance with another aspect of the present invention, the face member 1 may be provided with a support member 14, see FIG. 4, which may comprises a foldable structure attached to the back surface of the face member 1 and extending therefrom so that when the dartboard clock of the present invention is not attached to the dartboard 4, it may be supported on a substantially horizontal surface by the support provided by the support member 14.

In use, the dartboard clock is removed from the dartboard and then the timing hands (darts) 3 may be removed from the dartboard clock or other darts may be used to shoot the dartboard. Alternatively, by removing the timing hands from the dartboard clock, the dial plate (front surface of the face member) that has a dartboard pattern thereon may serve as a dartboard.

With such a dartboard clock structure provided by the present invention, there are several advantages. For example, when no dart game is played and the dartboard 4 is not in use, the dartboard clock of the present invention may be fixed to the dartboard to provide for example the functions of decoration and timing. Besides being fixed to a dartboard, the dartboard clock of the present invention may be used individually as a regular clock that has dartboard pattern as surface decoration.

Although preferred embodiments have been described to illustrate the present invention, it is apparent that changes and modifications in the specifically described embodiments can be carried out without departing from the scope of the invention which is intended to be limited only by the appended claims.

What is claimed is:

1. A dartboard clock comprising a face member having a disk plate having a front surface and a back surface, a circumferential flange extending from the back surface of the face member and having mounted thereon anchoring means adapted to anchor the dartboard clock to a pierceable article, the face member having a central through hole provided on the disk plate, a timing device having a rotating shaft extending therefrom to extend through and retained within the central hole of the disk plate with a remote end of the rotating shaft projecting out of the front surface of the face member for engaging timing hands which run on the front surface.

2. The dartboard clock as claimed in claim 1, wherein the pierceable article comprises a dartboard.

3. The dartboard clock as claimed in claim 1, wherein each of the timing hands comprises a dart having an elongated body with a sharp point section, a hole being provided on the dart to engage and fix to the remote end of the rotating shaft.

4. The dartboard clock as claimed in claim 1, wherein the anchoring means comprises a plurality of pins extending from the circumferential flange of the face member.

5. The dartboard clock as claimed in claim 4, wherein each of the pins comprises a point section of a dart with an end engaging and fixed within a hole provided on the circumferential flange of the face member.

6. The dartboard clock as claimed in claim 5, wherein the end of the pin has a thread and the hole provided on the circumferential flange of the face member has an inner thread to be threadingly engageable with the threaded end of the pin.

7. The dartboard clock as claimed in claim 1, wherein the face member has a foldable support member attached to the back surface thereof for independently supporting the dartboard clock on a substantially horizontal surface.

8. The dartboard clock as claimed in claim 1, wherein the front surface of the face member comprises a dartboard pattern provided thereon.

* * * * *